United States Patent [19]

Kumita et al.

[11] Patent Number: 5,008,501

[45] Date of Patent: Apr. 16, 1991

[54] COLLISION DETECTING DEVICE FOR MOTOR VEHICLES

[75] Inventors: Norio Kumita; Takaaki Yamamoto, both of Okazaki; Seiichi Narita, Kariya; Takaaki Ori, Nagoya, all of Japan

[73] Assignee: Nippondenso Co., Ltd., Kariya, Japan

[21] Appl. No.: 408,031

[22] Filed: Sep. 15, 1989

[30] Foreign Application Priority Data

Sep. 15, 1988 [JP] Japan ..... 63-231651
Aug. 8, 1989 [JP] Japan ..... 1-205097

[51] Int. Cl.[5] ..... H01H 35/14
[52] U.S. Cl. ..... 200/61.45 R; 200/61.48
[58] Field of Search ..... 200/61.45 R, 61.45 M, 200/61.46, 61.48–61.51, 61.52

[56] References Cited

U.S. PATENT DOCUMENTS

| | | | |
|---|---|---|---|
| 2,920,157 | 1/1960 | Rabinow et al. | 200/61.48 |
| 4,022,997 | 5/1977 | Inagaki et al. | 200/61.45 R |
| 4,104,493 | 8/1978 | Hibino et al. | 200/61.48 X |
| 4,188,517 | 2/1980 | Narita et al. | 200/61.45 R |
| 4,362,913 | 12/1982 | Kumita et al. | 200/61.45 R |

FOREIGN PATENT DOCUMENTS

| | | | |
|---|---|---|---|
| 2746985 | 4/1978 | Fed. Rep. of Germany | 200/61.45 R |
| 48-48169 | 6/1973 | Japan . | |

OTHER PUBLICATIONS

Takeda, Hideo, et al., "Some Considerations on Air Bag Restraint System Design", Honda R&D Co., Ltd., pp. 277.1–277.6, Nov. 1987.

*Primary Examiner*—J. R. Scott
*Attorney, Agent, or Firm*—Cushman, Darby & Cushman

[57] ABSTRACT

A collision detecting device for a motor vehicle includes a base plate coupled within an open end of a bottomed cylindrical case and secured in place to provide a sealed chamber, a support shaft rotatably mounted within the sealed chamber, a rotary member provided on the support shaft for rotation therewith and having the center of gravity positioned eccentrically from its rotational axis, a pair of contact elements provided on the rotary member for rotation therewith and being symmetrically arranged with respect to the rotational axis of the rotary member, a pair of electric terminals fixed to the base plate, the terminals each having an internal contact portion slidably engageable with each of the contact elements and an external terminal pin for connection to an electric control circuit, and a spring disposed within the sealed chamber to apply a counteracting rotational force to the rotary member depending on an angle of rotation through which the rotary member has rotated.

9 Claims, 3 Drawing Sheets

A
B
IX
IX

COLLISION DETECTING DEVICE FOR MOTOR VEHICLES

BACKGROUND OF THE INVENTION

1. Field of the Invention

The present invention relates to a collision detecting device for motor vehicles which is adapted to actuate a restraint system such as an air bag system upon detection of a collision of the vehicle.

2. Description of the Prior Art

In Japanese Utility Model Publication No. 60-35939, there has been proposed a collision detecting device of this kind which comprises a rotary member having the center of gravity positioned eccentrically from its rotational axis and a cam portion provided thereon and an electrical contact mechanism arranged to generate a collision signal therefrom when it has been brought into contact with the cam portion of the rotary member in the occurrence of a collision of the vehicle. The collision detecting device can be constructed by a relatively small number of component parts without causing any difficulty in assembly, and the electrical contact mechanism can be arranged to provide high reliability in operation. The electrical contact mechanism is, however, designed to be brought into contact with the cam portion of the rotary member only at one point. It is, therefore, required to preclude failure caused by secular change of the contact point.

To satisfy the requirement for the contact point, it has been considered to use gold-plated contacts in the electrical contact mechanism. It has been, however, found that each gold layer on the contacts becomes a porous layer through which copper components of the base plate for the contacts is precipitated due to chemical change and deposited on the surfaces of the contacts to cause insufficient conduction of the electrical contact mechanism. It has been also found that contaminants, water and defaced particles in the ambient atmosphere are adhered to the surfaces of the contacts to cause insufficient conduction of the electrical contact mechanism. In the collision detecting device to be actuated only in an accident, it is very important to eliminate such insufficient conduction of the electrical contact mechanism in a reliable manner.

SUMMARY OF THE INVENTION

It is, therefore, a primary object of the present invention to provide an improved collision detecting device capable of overcoming the problems discussed above.

According to the present invention, the object is attained by providing a collision detecting device which comprises a bottomed cylindrical case having an open end, a base plate rotatably coupled within the open end of the case and secured in place to provide a sealed chamber, a support shaft housed within the sealed chamber and being rotatably carried at one end thereof on the bottom of the case and at the other end thereof on the base plate, a rotary member provided on the support shaft for rotation therewith and having the center of gravity positioned eccentrically from its rotational axis, a pair of contact elements provided on the rotary member for rotation therewith and being symmetrically arranged with respect to the rotational axis of the rotary member, a pair of electric terminals fixed to the base plate, the electric terminals each having an internal contact portion slidably engageable with each of the contact elements and an external terminal pin for connection to an electric control circuit, and resilient means housed within the sealed chamber to apply a counteracting rotational force to the rotary member depending on an angle of rotation through which the rotary member has rotated.

In the collision detecting device described above, the contact elements are brought into slidable engagement with the respective internal contact portions of the electric terminals when the rotary member has been rotated against a preset load of the resilient means in the occurrence of a collision of the vehicle. Such slidable engagement of the contact elements with the respective internal contact portions of the terminals is effected in a rotational angle to ensure sufficient conduction between the terminals. This is useful to enhance reliability of the detecting device in operation. It is a feature of the present invention that the contact elements are symmetrically arranged with respect to the rotational axis of the rotary member. Such arrangement of the contact elements is useful to ensure smooth rotational movement of the rotary member.

BRIEF DESCRIPTION OF THE DRAWINGS

Other objects, features and advantages of the present invention will be readily appreciated from the following detailed description of certain preferred embodiments thereof when taken together with the accompanying drawings, in which.

DESCRIPTION OF THE PREFERRED EMBODIMENTS

Figure 1A:
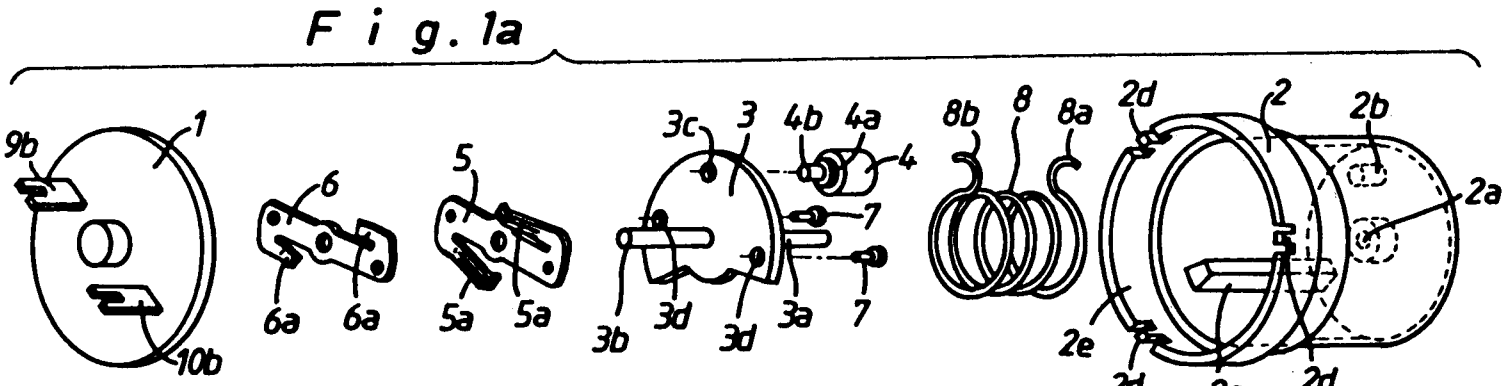
FIG. 1*a* is a perspective view of component parts incorporated in a collision detecting device of the present invention, in which the parts are illustrated for better understanding of the assembly order thereof.
Figure 1B:
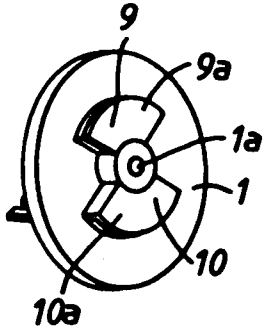
FIG. 1*b* is a right perspective of plate 1 shown in FIG. 1*a*.
Figure 4A:
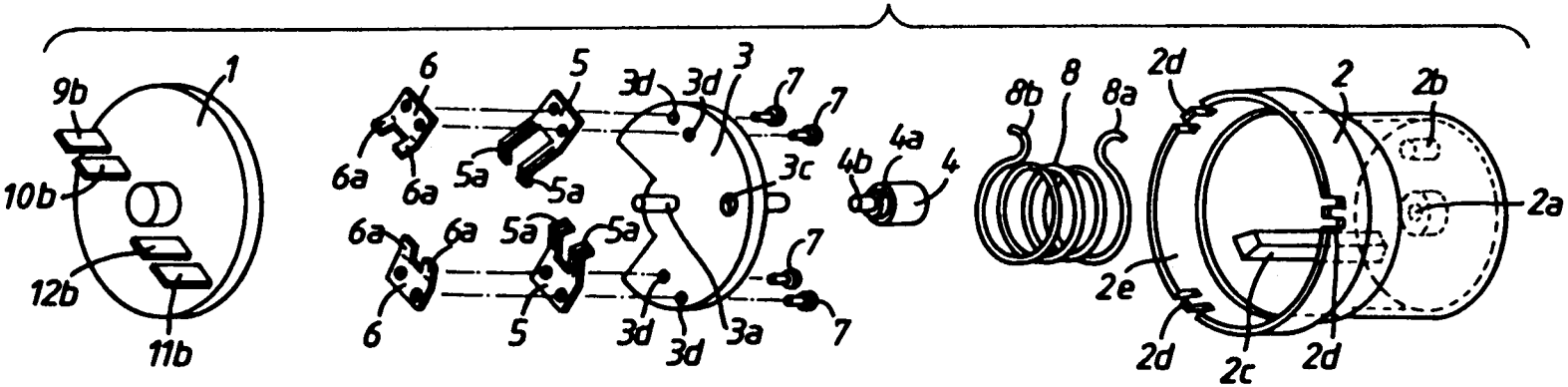
FIG. 4*a* is a perspective view of component parts incorporated in a modification of the collision detecting device shown in FIGS. 1–3, in which the parts are illustrated for better understanding of the assembly order thereof.

Referring now to the drawings, FIGS. 1*a*, 1*b*, 2 and 3 illustrate a collision detecting device in accordance with the present invention which includes, as main component parts, a base plate 1 in the form of a disc plate, a bottomed cylindrical case or shell 2, a rotary member 3, a weight element 4, a contact plate 5, a back-up plate 6, and a coil spring 8. As shown in FIGS. 1*a* and 1*b*, the base plate or disc plate 1 is made of hard synthetic resin and has a pair of electric terminals 9 and 10 inserted therethrough and secured thereto. The bottomed cylindrical case or shell 2 is made of hard synthetic resin and has an open end formed with an internal cylindrical stepped portion 2*e* for receiving therein the base plate 1. In a condition where the base plate 1 has been rotatably coupled with the internal cylindrical stepped portion 2*e* of case 2 in assembly, the base plate 1 is welded at 2*d* to the case 2 by heating to provide a sealed chamber. The rotary member 3 is made of metal and is integrally provided on a support shaft for rotation therewith. The support shaft of rotary member 3 is rotatably carried at its one end 3*a* on a bearing portion 2*a* of case 2 and at its other end 3*b* on a bearing portion 1*a* of base plate 1 to permit rotational movement of the rotary member 3 in the occurrence of a collision of the vehicle. The rotary member 3 is formed with a hole 3*c* for attachment with the weight element 4 and a pair of diametrically spaced holes 3*d* for attachment with the contact plate 5 and back-up plate 6.

The weight element 4 is made of heavy metal and has a stepped shoulder 4*a* for supporting thereon one end of the coil spring 8 and a projection 4*b* for attachment with the rotary member 3. The weight element 4 is inserted at its projection 4*b* through the hole 3*c* of rotary member 3 and secured in place by caulking to position the center of gravity of rotary member 3 eccentrically from its rotational axis. The contact plate 5 is made of highly conductive metal and has a pair of diametrically opposed leaf spring portions or contact elements 5*a*. The back-up plate 6 has a pair of diametrically opposed arms 6*a* for resiliently receiving the leaf spring portions 5*a* of contact plate 5. The contact plate 5 and back-up plate 6 are secured to the rotary member 3 by means of rivets 7 inserted therethrough at the holes 3*d* of rotary member 3. The coil spring 8 is assembled in surrounding relationship with the support shaft of rotary member 3 and is hooked at its one end 8*a* on an internal projection 2*b* of case 2 and at its other end 8*b* on the stepped shoulder 4*a* of weight element 4. Thus, the coil spring 8 is given a preset force to preclude the rotational movement of rotary member 3 during hard braking or other similar occurrences, and the rotary member 3 is positioned in place by abutment with an internal axial projection 2*c* of case 2 under the biasing force of spring 8.

Figure 2:
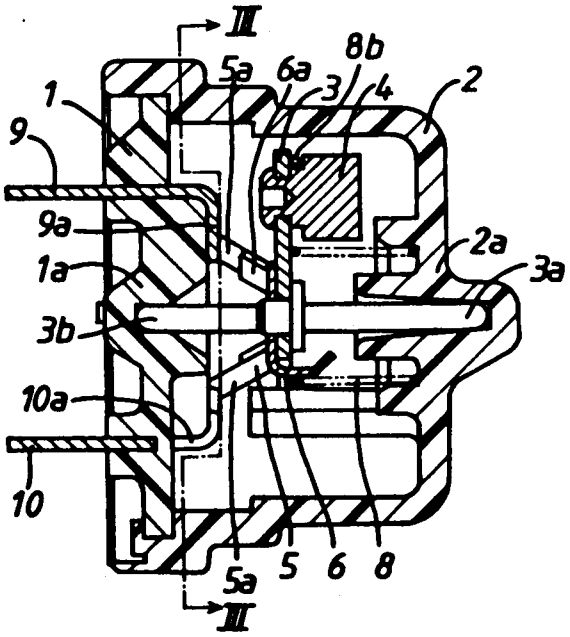
FIG. 2 is a sectional view of the collision detecting device in an assembled condition.
Figure 3:
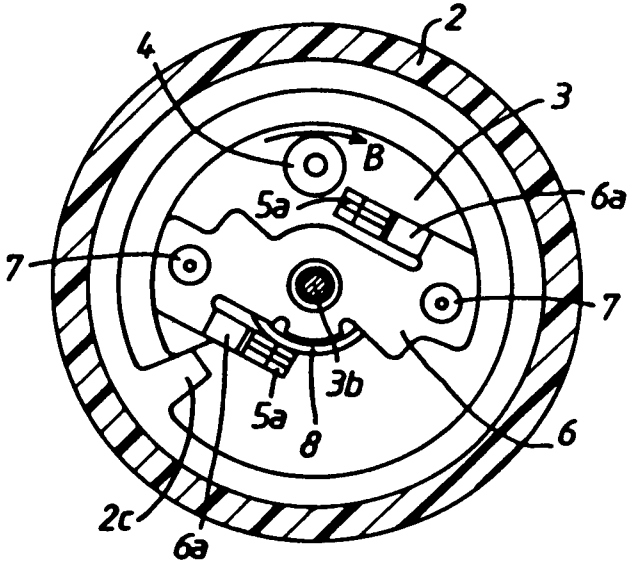
FIG. 3 is a cross-sectional view taken along line C—C in FIG. 2.

The electric terminals 9 and 10 each are integrally formed with internal contact portions 9*a*, 10*a* slidably engageable with the leaf spring portions 5*a* of contact plate 5 and external terminal pins 9*b*, 10*b* for connection to an electric control circuit (not shown). Such arrangement of the electric terminals 9 and 10 is useful to simplify the assembly of the component parts. In the collision detecting device assembled as shown in FIGS. 2 and 3, the leaf spring portions 5*a* of contact plate 5 are symmetrically arranged with respect to the rotational axis of rotary member 3 and are normally kept away from the internal contact portions 9*a*, 10*a* of electric terminals 9, 10 under the preset load of coil spring 8 but moved into contact with the latter in the occurrence of a collision as will be described below. In actual use, the collision detecting device is installed in the foremost part of the vehicle body or installed at the front end of the vehicle compartment.

Assuming that the collision detecting device has been applied with a momentary impact in the direction of arrow A in FIG. 3 in the occurrence of a collision of the vehicle, the rotary member 3 is rotated in the direction of arrow B in FIG. 3 as an impact force acting on the weight element 4 exceeds the preset load of spring 8. When the rotational movement of rotary member 3 exceeds a predetermined angle, the leaf spring portions 5*a* of contact plate 5 are brought into contact with the internal contact portions 9*a*, 10*a* of terminals 9, 10 to generate a collision signal therefrom. When the deceleration is below a predetermined value during travel of the vehicle on rough roads or during sudden braking, the impact force acting on the weight element 4 does not exceed the preset load of spring 8. Thus, the collision detecting device remains unactuated.

Figure 6:
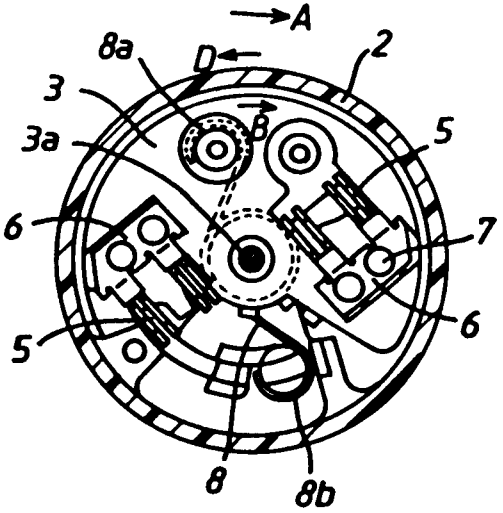
FIG. 6 is a cross-sectional view taken along line VI—VI in FIG. 5.
Figure 5:
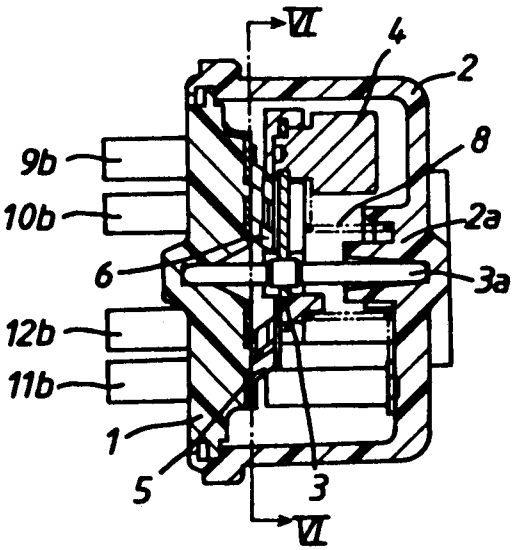
FIG. 5 is a sectional view of the modification in an assembled condition.
Figure 4B:
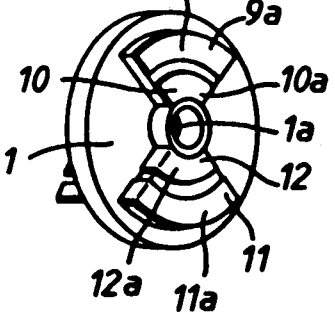
FIG. 4*b* is a right perspective of plate 1 shown in FIG. 4*a*.

In FIGS. 4*a*, 4*b*, 5 and 6 there is illustrated a modification of the collision detecting device wherein the contact plate 5 is replaced with a pair of contact plates, the back-up plate 6 is replaced with a pair of back-up plates, and the electric terminals 9, 10 are replaced with two pairs of electric terminals 9, 10, 11 and 12. In this modification, the contact plates 5 each are integrally formed with a pair of parallel leaf spring portions 5*a*, while the back-up plates 6 are each integrally formed with a pair of parallel arms 6*a*, 6*a* for resiliently receiving each pair of leaf spring portions 5*a* of contact plates 5. The rotary member 3 is formed with two pairs of diametrically spaced holes 3*d* for attachment with the contact plates 5 and back-up plates 6. Thus, the contact plates 5 and back-up plates 6 are secured to the rotary member 3 by means of rivets 7 inserted therethrough at the holes 3*d* of rotary member 3. The electric terminals 9, 10, 11 and 12 are integrally formed with internal contact portions 9*a*, 10*a*, 11*a* and 12*a* for engagement with the leaf spring portions 5*a* of contact plates 5 and external terminal pins 9*b*, 10*b*, 11*b* and 12*b* for connection to two electric control circuits (not shown), respectively. In the collision detecting device assembled as shown in FIGS. 5 and 6, each pair of leaf spring portions 5*a* of contact plates 5 are symmetrically arranged with respect to the rotational axis of rotary member 3 and are normally kept away from the internal contact portions 9*a*, 10*a* and 11*a*, 12*a* of the terminals under the preset load of coil spring 8 but moved into contact with the latter in the occurrence of a collision of the vehicle. Other construction and component parts are substantially the same as those of the collision detecting device shown in FIGS. 1*a*–3.

Assuming that the collision detecting device of FIGS. 5 and 6 has been applied with a momentary impact in the direction of arrow A in FIG. 6 in the occurrence of a collision of the vehicle, the rotary member 3 is rotated in the direction of arrow B in FIG. 6 as an impact force acting on the weight element 4 exceeds the preset load of spring 8. When the rotational movement of rotary member 3 exceeds a predetermined angle, the leaf spring portions 5*a* of contact plates 5 are brought into contact with the internal contact portions 9*a*, 10*a*, 11*a*, 12*a* of the terminals to generate two collision signals therefrom.

Figures 7A, 7B, 8, 9:
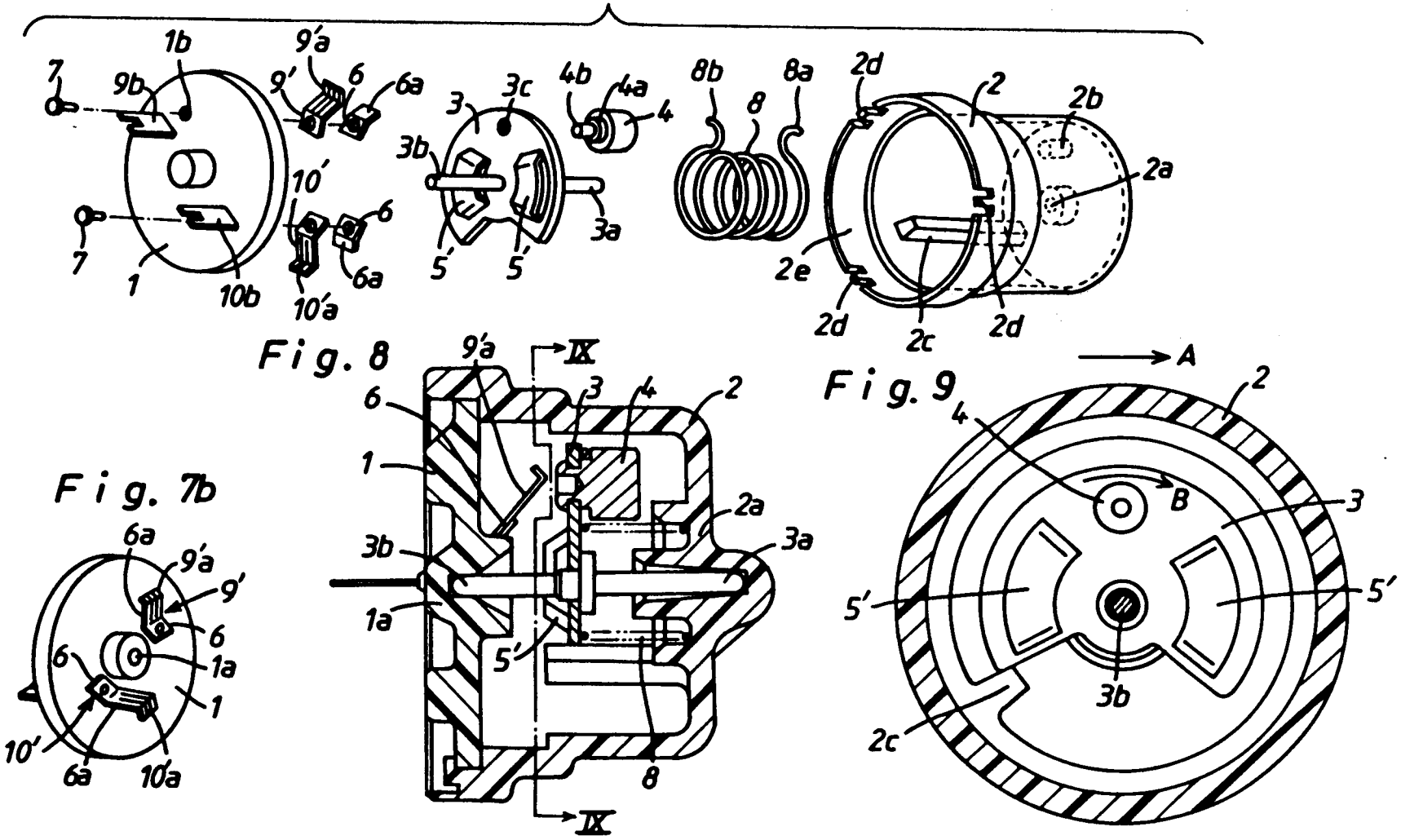
FIG. 7*a* is a perspective view of component parts of another modification of the collision detecting device shown in FIGS. 1–3, in which the parts illustrated for better understanding of the assembly order thereof.
FIG. 7*b* is a right perspective of plate 1 shown in FIG. 7*a*.
FIG. 8 is a cross-sectional view of the modification shown in FIG. 7 in an assembled condition.
FIG. 9 is a cross-sectional view taken along line IX—IX in FIG. 8.

In FIGS. 7*a*, 7*b*, 8 and 9 there is illustrated another modification of the collision detecting device shown in FIGS. 1*a*–3, wherein the contact plate 5 is replaced with a pair of diametrically spaced contact portions 5′ formed on the rotary member 3, the back-up plate 6 is replaced with a pair of back-up plates, and the internal contact portions 9*a*, 10*a* of terminals 9, 10 are replaced with a pair of internal contact plates 9′, 10′. The internal contact plates 9′, 10′ are integrally formed with leaf spring portions 9'a, 10'a, respectively. The back-up plates 6 each are integrally formed with an arm 6a for resiliently receiving each leaf spring portion of internal contact plates 9', 10'. The back-up plates 6 and internal contact plates 9', 10' are secured to the inner surface of base plate 1 by means of rivets 7 inserted therethrough at holes 1b of base plate 1, respectively. The internal contact plates 9', 10' are electrically connected to the inner ends of external terminal pins 9b, 10b. In the collision detecting device assembled as shown in FIGS. 8 and 9, the contact portions 5' of rotary member 3 are symmetrically arranged with respect to the rotational axis of rotary member 3 and are normally kept away from the leaf spring portions 9'a, 10'a of internal contact plates 9', 10' under the preset load of coil spring 8 but moved into contact with the latter in the occurrence of a collision of the vehicle. Other construction and component parts are substantially the same as those of the collision detecting device shown in FIGS. 1a-3.

Assuming that the collision detecting device of FIGS. 8 and 9 has been applied with a momentary impact in the direction of arrow A in FIG. 9 in the occurrence of a collision of the vehicle, the rotary member 3 is rotated in the direction of arrow B in FIG. 6 as an impact force acting on the weight element 4 exceeds the preset load of spring 8. When the rotational movement of rotary member 3 exceeds a predetermined angle, the contact portions 5' of rotary member 3 are brought into contact with the leaf spring portions 9'a, 10'a of internal contact plates 9', 10' to generate a collision signal therefrom.

In the respective collision detecting devices described above, the base plate 1 can be rotated after being coupled with the internal cylindrical stepped portion 2e of case 2. With such rotation of the base plate 1, the rotation angle of rotary member 3 for effecting conduction between the electric terminals can be adjusted in a range of 0° to 90°. In operation, the contact elements 5a are brought into slidable engagement with the respective internal contact portions of the electric terminals when the rotary member 3 has been rotated against the preset load of spring 8 in the occurrence of a collision of the vehicle. Such slidable engagement of the contact elements 5a with the respective internal contact portions of the terminals is effected in a rotational angle to ensure sufficient conduction between the terminals. This is useful to enhance reliability of the detecting device in operation. It is a feature of the present invention that the contact elements 5a are symmetrically arranged with respect to the rotational axis of the rotary member 3. Such arrangement of the contact elements 5a is useful to ensure smooth rotational movement of the rotary member 3. It is also an advantage of the present invention that the collision detecting devices can be easily assembled by fitting the component parts successively in one direction.

What is claimed is:

1. A collision detecting device for a motor vehicle comprising:

a cylindrical case having an open end and a bottom;

a base plate rotatably coupled within the open end of said case and secured in place to provide a sealed chamber;

a support shaft housed within said sealed chamber and being rotatably carried at one end thereof on the bottom of said case and at the other end thereof on said base plate;

a rotary member provided on said support shaft for rotation therewith and having the center of gravity positioned eccentrically from its rotational axis;

a pair of contact elements provided on said rotary member for rotation therewith and being symmetrically arranged with respect to the rotational axis of said rotary member;

a pair of electric terminals fixed to said base plate, said electric terminals each having an internal contact portion slidably engageable with each of said contact elements and an external terminal pin for connection to an electric control circuit; and resilient means housed within said sealed chamber to apply a counteracting rotational force to said rotary member depending on an angle of rotation through which said rotary member has rotated.

2. A collision detecting device as claimed in claim 1, wherein said contact elements are a pair of diametrically spaced leaf spring portions integral with a contact plate secured to said rotary member for rotation therewith.

3. A collision detecting device as claimed in claim 1, wherein the internal contact portion of each of said electric terminals is integrally formed with said external terminal pin.

4. A collision detecting device as claimed in claim 1, wherein the rotational angle of said rotary member for effecting conduction between said electric terminals can be adjusted by rotation of said base plate in a range of 0° to 90°.

5. A collision detecting device as claimed in claim 1, wherein said contact elements are a pair of diametrically spaced contact portions formed on said rotary member, and wherein the internal contact portion of each of said electric terminals is a leaf spring portion of a contact plate secured to an inner surface of said base plate and being electrically connected to the external terminal pin of each of said electric terminals.

6. A collision detecting device as claimed in claim 1, wherein said resilient means is a coil spring arranged in surrounding relationship with said support shaft and having one end fixed to a portion of said rotary member and the other end fixed to the bottom of said case.

7. A collision detecting device as claimed in claim 1, wherein each said contact elements is a resilient conductive member secured to said rotary member to be slidably engaged with the internal contact portion of each of said electric terminals when said rotary member has been rotated against a preset load of said resilient means in the occurrence of a collision of the vehicle.

8. A collision detecting device as claimed in claim 1, wherein said rotary member includes a weight element secured thereto at a position spaced eccentrically from its rotational axis.

9. A collision detecting device for a motor vehicle comprising:

a cylindrical case having an open end and a bottom;

a base plate rotatably coupled within the open end of said case and secured in place to provide a sealed chamber;

a support shaft housed within said sealed chamber and being rotatably carried at one end thereof on the bottom of said case and at the other end thereof on said base plate;

a rotary member provided on said support shaft for rotation therewith and having the center of gravity positioned eccentrically from its rotational axis;

a pair of contact plates secured to said rotary member and being symmetrically arranged with respect to the rotational axis of said rotary member, said contact plates each having a pair of parallel leaf spring portions;

two pairs of electric terminals fixed to said base plate, each pair of said electric terminals respectively having an internal contact portion slidably engageable with each of said leaf spring portions and an external terminal pin for connection to an electric control circuit; and resilient means housed within said sealed chamber to apply a counteracting rotational force to said rotary member depending on an angle of rotation through which said rotary member has rotated.

* * * * *